US008436534B2

(12) United States Patent
Park

(10) Patent No.: US 8,436,534 B2
(45) Date of Patent: May 7, 2013

(54) SURFACE LIGHT-EMITTING APPARATUS AND METHOD OF MANUFACTURING THE SAME

(75) Inventor: Young-Gu Park, Seoul (KR)

(73) Assignee: Nexon Co., Ltd, Gyeonggi-do (KR)

( * ) Notice: Subject to any disclaimer, the term of this patent is extended or adjusted under 35 U.S.C. 154(b) by 0 days.

(21) Appl. No.: 13/386,212

(22) PCT Filed: Sep. 25, 2009

(86) PCT No.: PCT/KR2009/005493
§ 371 (c)(1),
(2), (4) Date: Jan. 20, 2012

(87) PCT Pub. No.: WO2011/010775
PCT Pub. Date: Jan. 27, 2011

(65) Prior Publication Data

US 2012/0313515 A1 Dec. 13, 2012

(30) Foreign Application Priority Data

Jul. 22, 2009 (KR) ..... 10-2009-0066876

(51) Int. Cl.
*H05B 33/04* (2006.01)
*H05B 33/10* (2006.01)

(52) U.S. Cl.
USPC ..... 313/512; 313/505; 313/507; 445/24; 445/25

(58) Field of Classification Search ..... 313/498–512; 445/24–25
See application file for complete search history.

(56) References Cited

FOREIGN PATENT DOCUMENTS

| | | | |
|---|---|---|---|
| JP | 62-126856 | U | 8/1987 |
| JP | 2003-280534 | A | 10/2003 |
| JP | 2007-036132 | A | 2/2007 |
| KR | 10-2004-0033390 | A | 4/2004 |

*Primary Examiner* — Tracie Y Green
(74) *Attorney, Agent, or Firm* — MKG, LLC

(57) ABSTRACT

A surface light-emitting apparatus for emitting light from an entire surface thereof includes a framework having a predetermined shape and an LED disposed in the framework. A reflective layer is applied on an inner surface of the framework. The reflective layer can reflect light emitted from the LED. The apparatus includes a dispersing layer containing a multiplicity of diffuse-reflective particles operable to transmit at least a portion of the light emitted by the LED within the framework and diffuse-reflect at least a portion of the light along contact surfaces contacting each other. The apparatus includes a finishing layer including a light-transmitting resin disposed on the dispersing layer. The light emitted by the LED is dispersed and emitted through the diffuse-reflective particles.

10 Claims, 6 Drawing Sheets

[FIG.1]
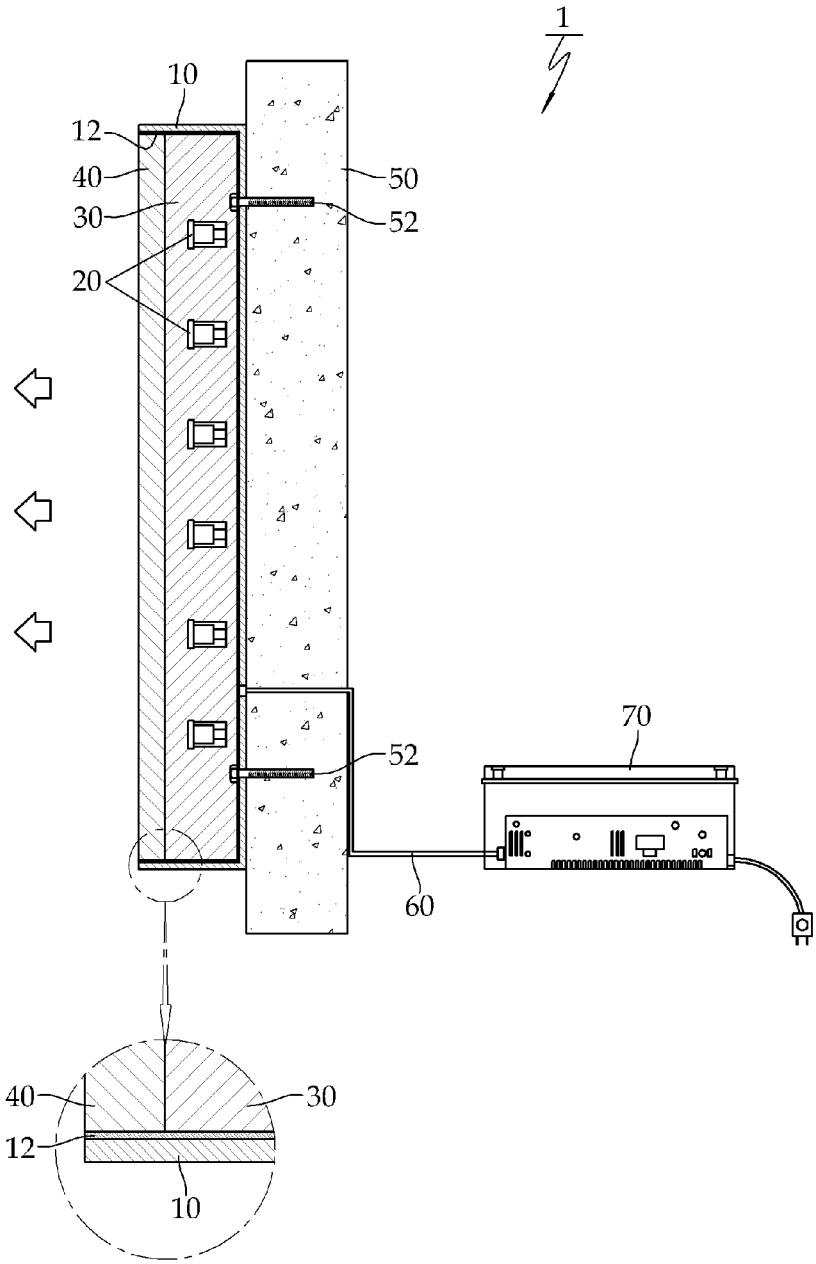

[FIG.2]
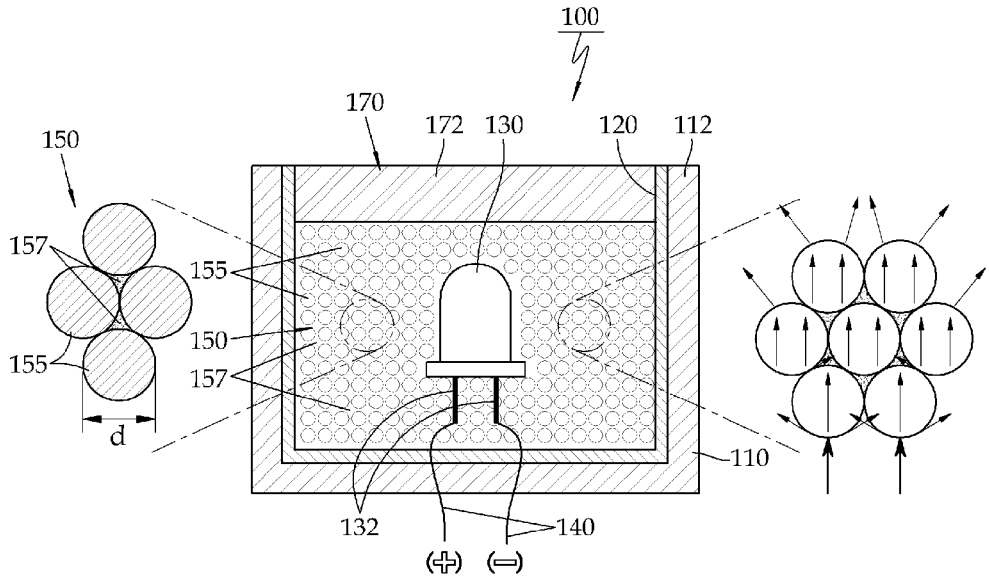

[FIG.3]
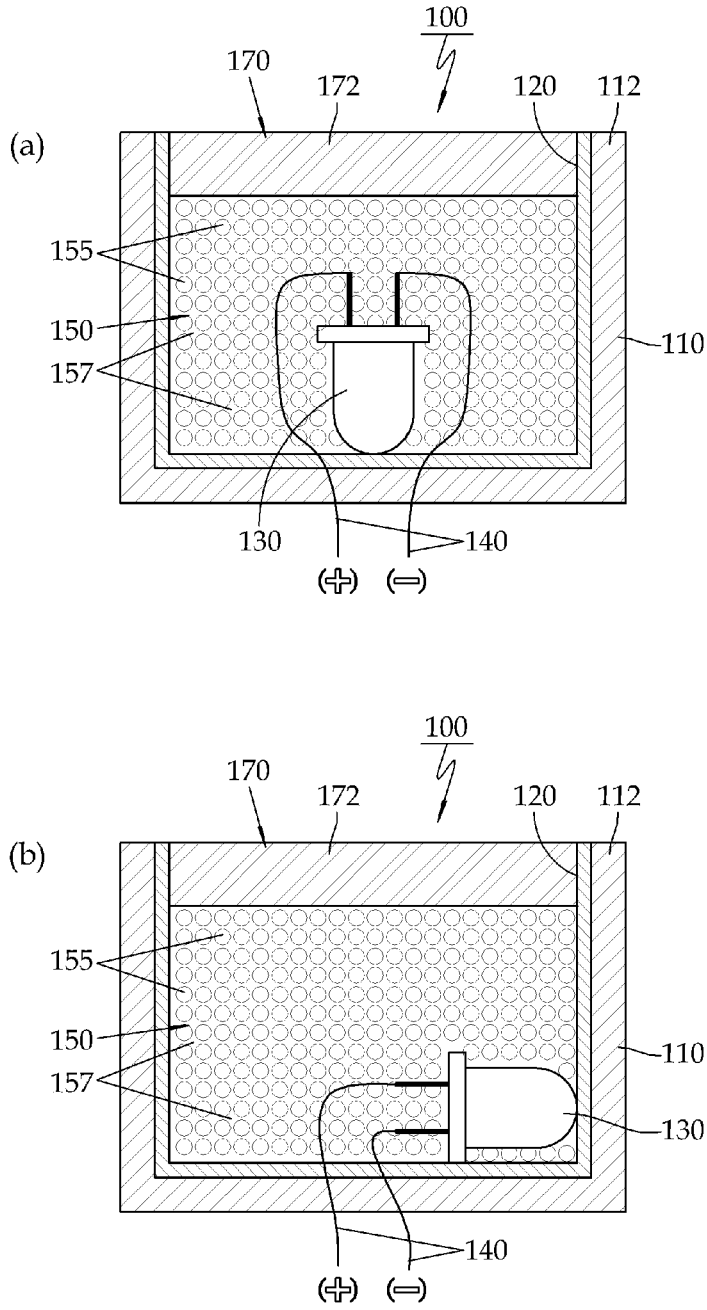

[FIG.4]
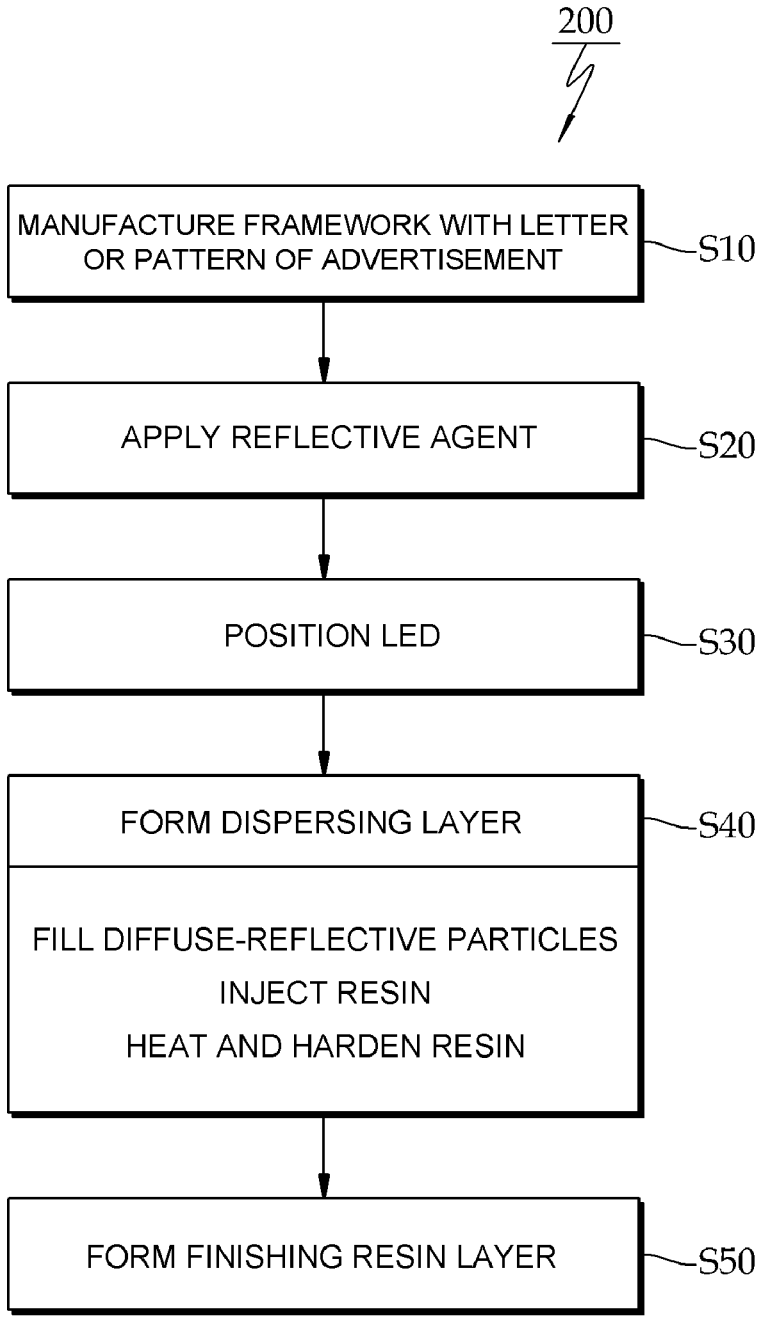

[FIG.5]
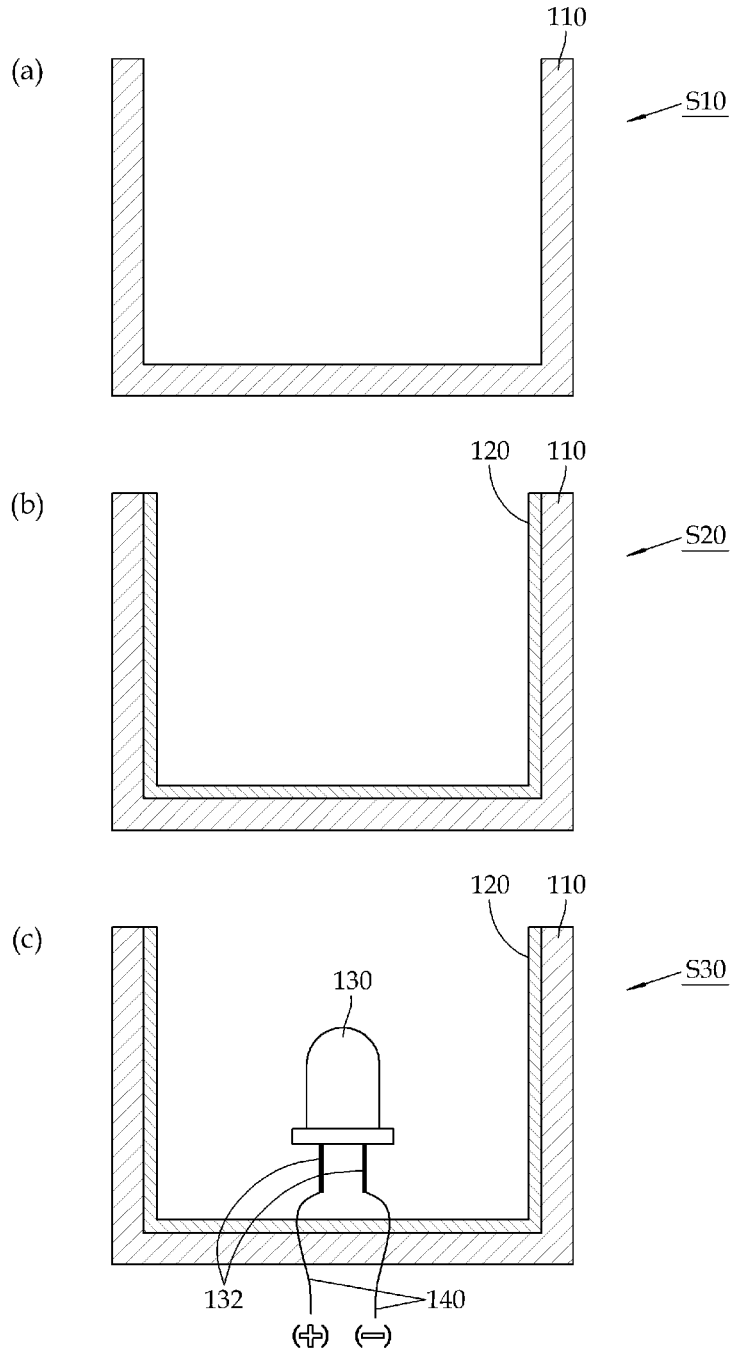

[FIG.6]
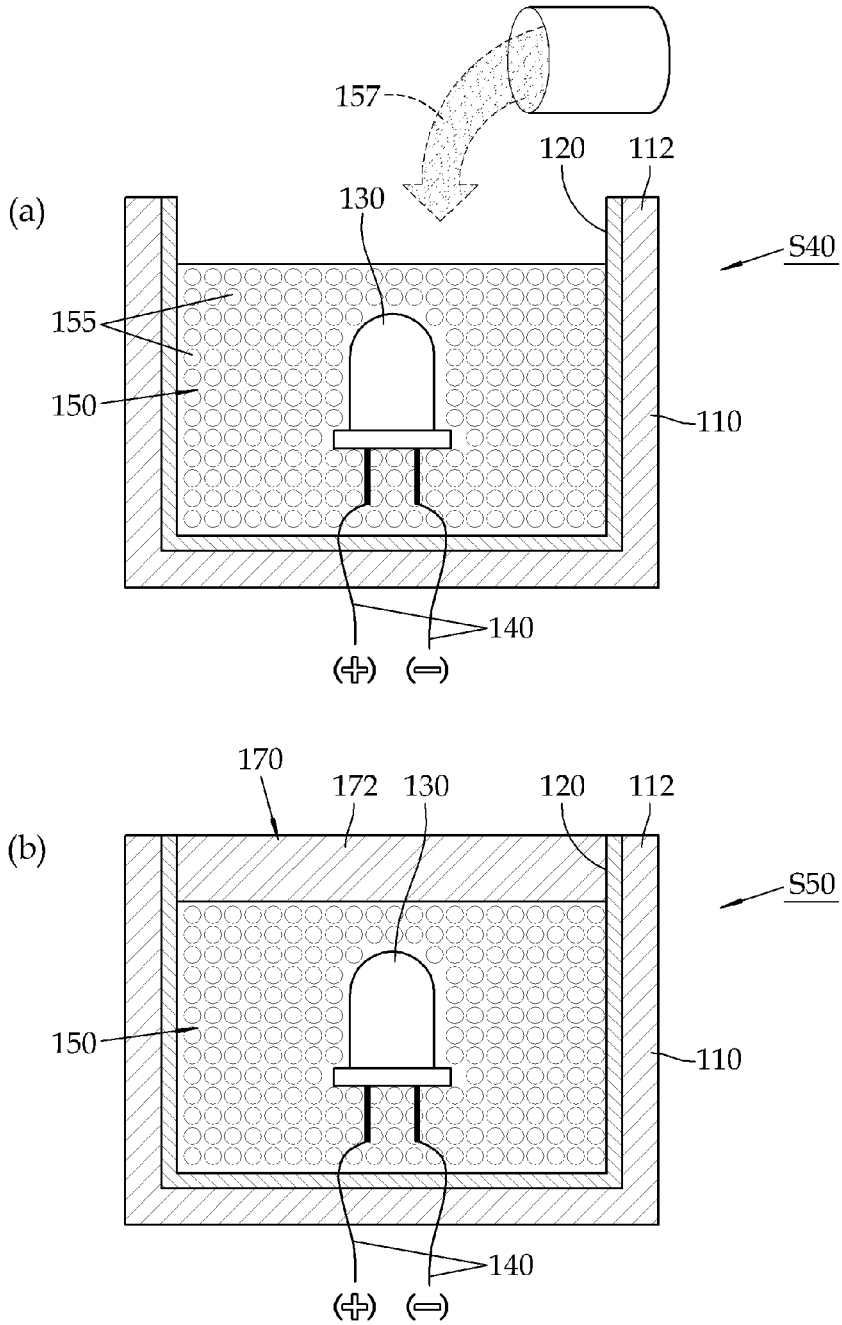

SURFACE LIGHT-EMITTING APPARATUS AND METHOD OF MANUFACTURING THE SAME

TECHNICAL FIELD

The present invention relates to a surface light-emitting apparatus using a light emitting diode (LED) and a method for manufacturing the same, and more particularly to a surface light-emitting apparatus which can make an overall structure lightweight by disposing diffuse-reflective particles having a relatively low specific gravity in a dispersing layer disposed within a framework. When light is emitted by the LED, some of the light is transmitted through the diffuse-reflective particles and the remaining light is diffused-reflected along surfaces of the particles, dispersing the light emitted by the LED more uniformly and surface-emitting the light from an entire surface thereof with a uniform illuminance.

BACKGROUND

Surface light-emitting apparatuses typically include LEDs secured to a frame. The LEDs are powered by an electric power supply. The surface light-emitting apparatuses are generally used for indoor or outdoor advertisements or signs, and have been developed to be configured such that they can be conveniently installed and have low electrical power consumptions and durability due to their simple structures. Light can be surface-emitted from LEDs during the day as well as at night.

FIG. 1 illustrates a sectional view of a conventional surface light-emitting apparatus 1.

The conventional surface light-emitting apparatus 1 is constructed by manufacturing a framework 10 having a letter or a pattern of a sign or an advertisement, applying a reflective agent 12 with a predetermined agent on an inner surface of the framework 10, disposing a plurality of LEDs 20 whose size and shape are not limited upward, downward, and laterally at an interval of 1 to 5 cm along the framework 10 within the reflective agent so that electric currents can flow to the LEDs 20 through wires, and fixing the LEDs 20 with a primary transparent epoxy resin 30 and a secondary epoxy resin 40 having a color.

After the surface light-emitting apparatus 1 is fixedly attached onto a wall 50 with bolts 52 and one side end of a wire 60 connected to the LEDs 20 is extracted to the outside of the framework 10, electric power is supplied to the wire 60 from a power supply unit 70, so that light can be surface-emitted from an entirety of the surface light-emitting apparatus 1. Accordingly, the surface light-emitting apparatus 1 can act as an effective advertisement.

However, according to the conventional surface light-emitting apparatus 1, a size of an advertisement is limited due to the heavy weights of the primary epoxy resin and the secondary epoxy resin when the advertisement is installed on the wall 50.

That is, the conventional surface light-emitting apparatus 1 requires a considerably large space in order that a coupling device including bolts 52 for fixing a relatively heavy advertisement can firmly support the advertisement. Further, it should have a complex structure, i.e. a large and complex structure for sufficiently supporting a load.

Meanwhile, Korean Patent No. 2002-0365307 titled "Indoor/outdoor Advertising Apparatus and Method for Manufacturing the Same" discloses another surface light-emitting apparatus.

However, the surface light-emitting apparatus is configured by applying a primary transparent epoxy resin with a height of 0.5 to 5 mm on an interior surface of a framework, disposing a plurality of LEDs on the primary transparent epoxy resin such that electric currents can flow to the LEDS, applying a secondary transparent epoxy resin or a transparent epoxy resin mixed with a dispersing agent such that the plurality of LEDs are buried, and applying a tertiary epoxy resin where a semi-transparent fluorescent pigment and a dispersing agent are mixed on the transparent epoxy resin.

Accordingly, the conventional surface light-emitting apparatus is configured such that it requires a separate dispersing layer for uniformly dispersing light emitted from LEDs, i.e. a dispersing agent and primary, secondary, tertiary epoxy resins should be filled on the whole. Thus, the conventional surface light-emitting apparatus also requires a heavy structure, a very complex manufacturing process, and high manufacturing costs.

Therefore, there has been a need for development of a new concept of a surface light-emitting apparatus which allows for a reduction of weight, simplification of a manufacturing process, and a reduction of manufacturing costs as compared with the conventional surface light-emitting apparatus 1.

SUMMARY

The present invention resides in one aspect in a surface light-emitting apparatus which requires a small-sized coupling device for installation thereof, thereby making the apparatus lightweight. The surface light-emitting apparatus disperses light emitted by LEDs, emitting light of a uniform illuminance from an entire surface thereof even with a small-sized dispersing layer to improve an advertising effect and realizing a slimness of an advertisement on the whole, and a method for manufacturing the same. Further, another aspect of the present invention provides a surface light-emitting apparatus which can be manufactured in a simple process, remarkably lowering manufacturing costs and making a product competitive, and a method for manufacturing the same.

In accordance with an aspect of the present invention, there is provided a surface light-emitting apparatus for emitting light from an entire surface thereof with an LED acting as a light source, the surface light-emitting apparatus including: a framework having a predetermined shape; a reflective layer including a reflective paint applied on an inner surface of the framework to reflect light of the LED; the LED emitting light within the framework through supply of electric power; a dispersing layer containing a multiplicity of diffuse-reflective particles which transmit some of the light emitted by the LED within the framework and diffuse-reflect some of the light along contact surfaces contacting each other, in order to disperse the light of the LED; and a finishing layer including a light-transmitting resin disposed on the dispersing layer so as to make an entire surface thereof smooth, whereby the light emitted by the LED is dispersed and emitted through the diffuse-reflective particles. Thus, the present invention can make the total weight of the surface light-emitting apparatus light and improve an effect of dispersing light emitted by the LED, making an advertising effect of an advertisement excellent.

In one embodiment, the diffuse-reflective particles of the dispersing layer include semi-transparent polypropylene resin particles or transparent acryl resin particles, are filled within the framework so that the LED is buried and are filled up to a height substantially 2 to 3 mm below an upper end edge of the framework, and a light-transmitting resin is filled in spaces between the diffuse-reflective particles up to a height of the diffuse-reflective particles so as to be integrally formed with the diffuse-reflective particles. Accordingly, the weight of the dispersing layer is made light, making it possible to significantly reduce the weight of an advertisement and improve an effect of dispersing light emitted by the LED.

In another aspect disclosed herein, the finishing layer includes a light-transmitting resin disposed within the framework such that an upper surface thereof coincides with a height of an upper end of the framework and a lower surface thereof is integrally formed with an upper surface of the dispersing layer. Through the finishing layer, an entire surface of the surface light-emitting layer can be made smooth and an outer appearance of an advertisement can be made appealing.

The diffuse-reflective particles can be spherical particles having a diameter of 1 to 10 mm and a specific gravity lower than that of the light-transmitting resin. Thus, the diffuse-reflective particles can make the dispersing layer light and disperse the light emitted by the LED with a more uniform illuminance.

In another embodiment, the light-transmitting resin may be an epoxy resin. Through this, a low-priced surface light-emitting apparatus with an excellent performance can be manufactured. The epoxy resin has an excellent light-transmitting performance, and has a desirable property which is less subject to a yellowing phenomenon and a crack due to ultraviolet rays and also less subject to a contraction due to heat.

In accordance with another aspect of the present disclosure, the LED is disposed within the framework such that a light-emitting surface thereof faces upward, downward, or laterally, and lead wires thereof are electrically connected to electric wires of the outside. Thus, the LED can be disposed in various forms and can disperse light uniformly through the dispersing layer irrespective of a disposition of the LED.

In accordance with another aspect of the present invention, there is provided a method of manufacturing a surface light-emitting apparatus configured to emit light from an entire surface thereof with an LED acting as a light source, the method including: manufacturing a framework with a letter or a pattern of an advertisement; applying a reflective agent on an inner surface of the framework and forming a reflective layer; installing the LED within the framework and positioning the LED such that electric currents flow to the LED along wires; filling a multiplicity of diffuse-reflective particles within the framework outside the LED and forming a dispersing layer so that some of the light emitted by the LED is transmitted and some of the light is diffuse-reflected along contact surfaces contacting each other; and forming a light-transmitting thermosetting resin layer on the dispersing layer and forming a finishing layer for making an entire surface thereof smooth. Thus, the present invention can simplify the manufacturing process and remarkably reduce the manufacturing costs of the surface light-emitting apparatus, making the surface light-emitting apparatus competitive.

In one embodiment, in forming of the dispersing layer, diffuse-reflective particles are substantially spherical particles with a diameter of 1 to 10 mm are filled within the framework so that the LED is buried, and a light-transmitting resin is filled in spaces between the diffuse-reflective particles up to a height of the diffuse-reflective particles and is heated and hardened to be fixed. In this way, the present invention can make the surface light-emitting apparatus light, remarkably reduce the weight of an advertisement, and form the dispersing layer which improves an effect of dispersing light emitted by the LED.

The diffuse-reflective particles of the dispersing layer may include semi-transparent polypropylene resin particles or transparent acryl resin particles. In this case, it should be understood that the diffuse-reflective particles include all particles which consist of any transparent or semi-transparent resin which can diffuse light emitted by the LED.

In forming of the finishing layer, the light-transmitting resin is applied on the dispersing layer up to a height of an upper end of the framework and is heated and hardened. Through this, the present invention can form the finishing layer which makes an entire surface of the surface light-emitting apparatus smooth and makes an appearance of an advertisement appealing.

In forming of the finishing layer, after the light-transmitting resin is formed to have a size corresponding to a height between the dispersing layer and an upper end edge of the framework at the outside of the framework through heating and hardening, the light-transmitting resin can be inserted into the framework to be fixed to an upper side of the dispersing layer. Thus, the present invention can form the finishing layer which makes an entire surface of the surface light-emitting apparatus smooth and makes an appearance of an advertisement appealing.

According to the present invention, since the dispersing layer contains diffuse-reflective particles having a specific gravity lower than that of a light-transmitting resin and a size of 1 to 10 mm, the total weight of the surface light-emitting apparatus can be reduced by at least 10 to 20%. Thus, a coupling device for installation of an advertisement can be made small-sized.

Further, according to the present invention, since the diffuse-reflective particles contained in the dispersing layer transmit some of light emitted by an LED and diffuse-reflect some of the light along contact surfaces contacting each other, an effect of dispersing the light emitted by the LED can be improved, making it possible to emit light of a uniform illuminance from an entire surface of the surface light-emitting apparatus even with a small-sized dispersing layer. Thus, since an advertisement can be shown more clearly, an advertising effect can be improved, making it possible to slim the advertisement on the whole.

In addition, according to the present invention, since a simple structure manufactured with the dispersing layer containing the diffuse-reflective particles outside the LED and the finishing layer outside the dispersing layer simplifies the manufacturing process of the surface light-emitting apparatus and allows an easy manufacturing of the surface light-emitting apparatus, the manufacturing costs of the surface light-emitting apparatus can be lowered remarkably, making a product competitive.

BRIEF DESCRIPTION OF THE DRAWINGS

The above and other objects, features and advantages of the present invention will be more apparent from the following detailed description taken in conjunction with the accompanying drawings, in which:

FIG. 1 is a longitudinal sectional view illustrating a prior art surface light-emitting apparatus; FIGS. 2A and 2B are longitudinal sectional views illustrating a surface light-emitting apparatus containing diffuse-reflective particles in a dispersing layer according to the present invention;

FIG. 3A is a longitudinal sectional view illustrating a structure of a surface light-emitting apparatus where a light-emitting surface of an LED faces a lower side according to the present invention;

FIG. 3B is a longitudinal sectional view illustrating a structure of a surface light-emitting apparatus where a light-emitting surface of an LED faces a lateral side according to the present invention;

FIG. 4 is a flowchart illustrating a method of manufacturing a surface light-emitting apparatus according to the present invention in stages;

FIGS. 5A, 5B, and 5C are process views illustrating the method of manufacturing a surface light-emitting apparatus according to the present invention in stages, and sequentially illustrate a process of positioning an LED within a framework;

FIGS. 6A and 6B are process views illustrating the method of manufacturing a surface light-emitting apparatus according to the present invention in stages, and sequentially illustrate a process of forming a dispersing layer and a finishing layer.

DETAILED DESCRIPTION

As illustrated in FIG. 2A, a surface light-emitting apparatus 100 according to the present invention includes a framework 110 having a predetermined shape. The framework 110 is curved according to a letter or a pattern of an advertisement. A cross section of the framework 110 is U-shaped.

A reflective layer 120 is formed on an inner surface of the framework 110. The reflective layer 120 is formed by applying a coating of a reflective agent such as a glossy reflective paint to the inner surface of the framework. The reflective layer 120 is configured to reflect light from an LED 130 as described below.

The LED 130 emits light within the framework 110 through supply of electric power. A plurality of LEDs 130 may be mounted within the framework 110 along the framework 110, and electric wires 140 are connected to grid wires 132 so that the LEDs 130 emit light when electric power is supplied to the LEDs 130 from the outside.

FIG. 2B is a view illustrating that an LED of an SMD (Surface Mount Device) type can be mounted within a framework 110, wherein an LED is a concept used in a wide sense and should be construed to include all types of LEDS.

The LED 130 may be disposed within the framework such that a light-emitting surface thereof faces upward, or may be disposed such that a light-emitting surface thereof faces downward or laterally as illustrated in FIGS. 3A and 3B.

A dispersing layer 150 which transmits some of the light emitted by the LED 130 and disperses some of the light emitted by the LED 130 by using a multiplicity of diffuse-reflective particles 155 diffuse-reflecting the light along contact surfaces contacting each other.

The diffuse-reflective particles 155 of the dispersing layer 150 include, for example, semi-transparent polypropylene resin particles or transparent acryl resin particles, are filled within the framework 110 so that the LED 130 is buried, and are filled up to a height substantially 2 to 3 mm below an upper end edge 112 of the framework 110. A light-transmitting resin 157 is filled in the spaces between the diffuse-reflective particles 155 up to the height of the diffuse-reflective particles 155 to integrate the diffuse-reflective particles 155 and fix the diffuse-reflective particles 155 within the framework 110.

The diffuse-reflective particles 155 correspond to spherical particles with a diameter (d) of 1 to 10 mm, and have a specific gravity lower than that of the light-transmitting resin 157. Thus, the diffuse-reflective particles 155 make the dispersing layer 150 lightweight due to their low specific gravity. The diffuse-reflective particles 155 transmit some of the light emitted from the LED 130 and diffuse-reflect the remaining light along contact surfaces contacting each other, dispersing the light with a more uniform illuminance.

The dispersing layer 150 disperses light uniformly through the diffuse-reflective particles 155 irrespective of the disposition of the LEDs 130 even when light-emitting surfaces of the LEDs 130 located within the diffuse-reflective particles 155 are disposed in any direction, i.e. upward, downward, or laterally.

The finishing layer 170 is formed on the dispersing layer 150, and includes a light-transmitting resin 172 to make an entire surface of the finishing layer 170 smooth. The finishing layer 170 is disposed within the framework 110 such that an upper surface thereof corresponds to a height of an upper end of the framework 110 and a lower surface thereof is integrally formed with an upper surface of the dispersing layer 150.

In this way, the light-transmitting resins 157 and 172 used for the dispersing layer 150 and the finishing layer 170 correspond to an epoxy resin, by which a surface light-emitting apparatus 100 can achieve an excellent light-transmitting property, be less subject to a yellowing phenomenon and a crack due to an ultraviolet light, and be less subject to a contraction due to heat, ensuring a desirable property and an inexpensive and stable structure. It is apparent that the light-transmitting resins 157 and 172 can emit light with a desired color by mixing a desired color pigment with an epoxy resin.

Hereinafter, a method 200 of manufacturing a surface light-emitting apparatus according to the present invention will be described in more detail with reference to FIGS. 4 to 6.

First, according to the present invention, as illustrated in FIG. 4 on the whole, the method 200 of manufacturing a surface light-emitting apparatus includes a step S10 of manufacturing a framework 110 having a letter or a pattern of an advertisement. As illustrated in FIG. 5A, the framework 110 is machined to have a U-like cross-section and be curved in various forms according to a letter or a pattern of an advertisement.

Next, a step S20 of applying a reflective agent on an inner surface of the framework 110 and forming a reflective layer 120 is performed. The reflective layer 120 is formed by applying the reflective agent such as a glossy reflective paint and hardening the reflective agent, and is applied on the inner surface of the framework 110 as illustrated in FIG. 5B to totally-reflect light of LEDs 130.

After the reflective layer 120 is formed, a step S30 of installing the LEDs 130 within the framework 110 and positioning the LEDs 130 such that electric currents can flow to the LEDs 130 along electric wires 140 is performed.

In the step S30 of positioning the LEDs 130, a plurality of LEDs 130 may be mounted within the framework 110 along the framework 110, and their lead wires 132 are connected to the electric wires 140 so that electric power can be supplied to the LEDs 130 from the outside.

Then, light-emitting surfaces of the LEDs 130 may be disposed upward within the framework 110 in various forms according to a form of an advertisement as illustrated in FIG. 5C, or may be disposed downward or laterally as illustrated in FIGS. 3A and 3B.

Next, a step S40 of filling a multiplicity of diffuse-reflective particles 155 within the framework 110 outside the LEDs 130 and forming a dispersing layer 150 so that some of the light emitted by the LEDs 130 can be transmitted and some of the light can be diffuse-reflected along contact surfaces contacting each other is performed.

The step S40 of forming the dispersing layer 150 is performed by filling the diffuse-reflective particles 155 including semi-transparent polypropylene resin particles or transparent acryl resin particles corresponding to spherical particles with a diameter (d) of 1 to 10 mm within the framework 110 such that the LEDs 130 are buried in the diffuse-reflective particles 155 as illustrated in FIG. 6A, injecting a light-transmitting resin 157 between the diffuse-reflective particles 155 up to the height of the diffuse-reflective particles 155, and heating and hardening the light-transmitting resin 157 to fix the diffuse-reflective particles 155.

Then, the diffuse-reflective particles 155 are filled up to approximately 2 to 3 mm below an upper end edge 112 of the framework 110, and the light-transmitting resin 157 filled in the spaces between the diffuse-reflective particles 155 is thermally hardened by applying heat of 45 to 50 degrees Celsius for 6 hours.

The diameter (d) of the diffuse-reflective particles 155 are 1 to 10 mm. If the diameter (d) of the diffuse-reflective particles 155 is less than 1 mm, the particles themselves have a low specific gravity which causes the particles to be swollen due to buoyancy when the light-transmitting resin 157, i.e. an epoxy resin is injected, so it is difficult to accurately adjust the height of the particles. Further, when the diameter (d) of the particles is more than 10 mm, contact surfaces between the particles are too large, so it is difficult to irradiate light uniformly due to unsmooth diffuse-reflection.

Accordingly, the present invention can reduce the weight of the surface light-emitting apparatus 100 through the diffuse-reflective particles 155 contained in the dispersing layer 150, significantly reducing the weight of an advertisement, and makes excellent an effect of dispersing light emitted by the LEDs 130 by the dispersing layer 150.

When the dispersing layer 150 is formed in this way, it is formed with the diffuse-reflective particles 155 and the light-transmitting resin 157, i.e. an epoxy resin, in which case a surface of the dispersing layer 150 is formed unevenly due to the diffuse-reflective particles 155. A step S50 of forming a finishing layer 170 on the dispersing layer 150 to make an entire surface of the finishing layer 170 smooth is performed to finish the surface of the dispersing layer 150.

As illustrated in FIG. 6B, in the step S50 of forming the finishing layer 170, the light-transmitting resin 172 including an epoxy resin is applied on the dispersing layer 150 to coincide with the height of an upper end of the framework 110, and is heated and hardened.

That is, the light-transmitting resin 172 is applied on the dispersing layer 150 up to the height of the upper end of the framework 110, and is heated and hardened to make the entire surface of the surface light-emitting apparatus 100 smooth and make an outer appearance of an advertisement appealing.

Alternatively, in the step S50 of forming the finishing layer 170, after the light-transmitting resin 172 is heated and hardened to have a size corresponding to the height between the dispersing layer 150 and the framework 110, it is inserted into the framework 110 to be fixed to an upper side of the dispersing layer 150.

That is, the finishing layer 170 is manufactured at the outside separately, and is inserted into and fixed to the framework 110 such that an entire surface of the finishing layer 170 coincides with the height of an upper end of the framework 110, making it possible to make the entire surface of the finishing surface 170 smooth and make an outer appearance of an advertisement appealing. Then, an adhesive (not shown) may be applied at a periphery of the finishing layer 170 manufactured at the outside to be bonded to the framework 110.

According to the present invention, since the multiplicity of diffuse-reflective particles 155 with a size of 1 to 10 mm having a specific gravity lower than that of the light-transmitting resin 157 are contained in the dispersing layer 150 surrounding the LEDs 130, the overall weight of an advertisement can be reduced by at least 10 to 20% so that the advertisement can be easily fixed to the wall 50.

In addition, since the diffuse-reflective particles 155 contained in the dispersing layer 150 transmit some of the light emitted by the LEDs 130 and diffuse-reflect some of the light along contact surfaces of the contacting particles, an effect of dispersing the light emitted by the LEDs 130 can become excellent, making it possible to disperse light with a uniform illuminance from an entire surface of the surface light-emitting apparatus 100 even with the dispersing layer 150 with a small size. Accordingly, an advertising effect can become more excellent by showing an advertisement more clearly at night, and realizing slimness of the advertisement on the whole.

Furthermore, since the dispersing layer 150 containing the diffuse-reflective particles 155 is integrally formed with the outside of the LEDs 130 and the finishing layer 170 is formed at the outside with a simple structure, the manufacturing process can be simplified. Thus, the surface light-emitting apparatus 150 can be easily manufactured and the manufacturing costs can be significantly reduced, making a product competitive.

Although the present invention has been described with reference to the limited example and drawings, the present invention is not limited thereto. Further, those skilled in the art will appreciate that various modifications, additions and substitutions are possible, without departing from the scope and spirit of the invention as disclosed in the accompanying claims. It will be noted that simple corrections of the embodiments and modification of designs clearly pertain to the scope of the present invention.

What is claimed is:

1. A surface light-emitting apparatus for emitting light from an entire surface thereof comprising:

a framework having a predetermined shape;

an LED disposed in the framework, the LED being operable to emit light within the framework;

a reflective layer applied on an inner surface of the framework, the reflective layer being operable to reflect the light emitted by the LED;

a dispersing layer containing a multiplicity of diffuse-reflective particles operable to transmit at least a portion of the light emitted by the LED within the framework and diffuse-reflect at least a portion of the light along contact surfaces contacting each other, in order to disperse the light emitted by the LED;

a finishing layer including a light-transmitting resin disposed on the dispersing layer so as to make an entire surface thereof smooth, and the light emitted by the LED is dispersed and emitted through the diffuse-reflective particles.

2. The surface light-emitting apparatus of claim 1, wherein:

the diffuse-reflective particles of the dispersing layer include at least one of semi-transparent polypropylene resin particles and transparent acryl resin particles;

the diffuse-reflective particles are disposed within the framework so that the LED is buried and are filled to a height about 2 to 3 mm below an upper end edge of the framework; and a light-transmitting resin is disposed in spaces between the diffuse-reflective particles up to a height of the diffuse-reflective particles so as to be integrally formed with the diffuse-reflective particles.

3. The surface light-emitting apparatus of claim 1, wherein the finishing layer includes a light-transmitting resin disposed within the framework such that an upper surface thereof coincides with a height of an upper end of the framework and a lower surface thereof is integrally formed with an upper surface of the dispersing layer.

4. The surface light-emitting apparatus of claim 2, wherein the diffuse-reflective particles are spherical particles having a diameter of 1 to 10 mm and a specific gravity lower than that of the light-transmitting resin.

5. The surface light-emitting apparatus of claim 1, wherein the LED is disposed within the framework such that a light-emitting surface thereof faces upward, downward, or laterally, and lead wires thereof are electrically connected to electric wires of the outside.

6. A method of manufacturing a surface light-emitting apparatus configured to emit light from an entire surface thereof with an LED acting as a light source, the method comprising:

manufacturing a framework with a letter or a pattern of an advertisement;

applying a reflective agent on an inner surface of the framework and forming a reflective layer;

installing the LED within the framework and positioning the LED such that electric currents flow to the LED along wires;

disposing a multiplicity of diffuse-reflective particles within the framework outside the LED and forming a dispersing layer so that at least a portion of the light emitted by the LED is transmitted and at least a portion of the light is diffuse-reflected along contact surfaces contacting each other; and forming a light-transmitting thermosetting resin layer on the dispersing layer and forming a finishing layer for making an entire surface thereof smooth.

7. The method of claim 6, wherein in forming of the dispersing layer, diffuse-reflective particles corresponding to spherical particles with a diameter of 1 to 10 mm are disposed within the framework so that the LED is buried, and a light-transmitting resin is disposed in spaces between the diffuse-reflective particles up to a height of the diffuse-reflective particles and is heated and hardened to be fixed.

8. The method of claim 7, wherein the diffuse-reflective particles of the dispersing layer include semi-transparent polypropylene resin particles or transparent acryl resin particles.

9. The method of claim 6, wherein in forming of the finishing layer, the light-transmitting resin is applied on the dispersing layer up to a height of an upper end of the framework and is heated and hardened.

10. The method of claim 6, wherein in forming of the finishing layer, after the light-transmitting resin is formed to have a size corresponding to a height between the dispersing layer and an upper end edge of the framework at the outside of the framework through heating and hardening, the light-transmitting resin is inserted into the framework to be fixed to an upper side of the dispersing layer.

* * * * *